US006253928B1

(12) United States Patent
Weber

(10) Patent No.: US 6,253,928 B1
(45) Date of Patent: Jul. 3, 2001

(54) GRAIN GRADER

(75) Inventor: Joseph A. Weber, Frisco, TX (US)

(73) Assignee: Gustafson, LLC, Skakopee, MN (US)

( * ) Notice: Subject to any disclaimer, the term of this patent is extended or adjusted under 35 U.S.C. 154(b) by 0 days.

(21) Appl. No.: 09/266,672

(22) Filed: Mar. 11, 1999

(51) Int. Cl.[7] ..... B07B 1/50; B07B 13/04
(52) U.S. Cl. ..... 209/683; 209/384; 209/389
(58) Field of Search ..... 209/384, 379, 209/381, 385, 389, 683, 270

(56) References Cited

U.S. PATENT DOCUMENTS

| | | | | |
|---|---|---|---|---|
| 89,927 | | 5/1869 | Garner | 209/384 |
| 174,078 | | 2/1876 | Kurth | 209/384 |
| 310,335 | * | 1/1885 | Tracy | 208/384 |
| 399,779 | | 3/1889 | Rattan | 209/384 |
| 410,377 | | 9/1889 | Rich | 209/384 |
| 608,230 | * | 8/1898 | Scott et al. | 209/384 |
| 1,147,283 | | 7/1915 | Tuttle . | |
| 1,213,239 | | 1/1917 | Noll . | |
| 1,681,422 | | 8/1928 | McAuliff . | |
| 1,841,299 | | 1/1932 | Rife . | |
| 2,478,246 | | 8/1949 | Cortese et al. | 209/384 |
| 4,322,289 | | 3/1982 | Goncharov | 209/384 |
| 4,469,230 | | 9/1984 | Gorlitz et al. | 209/683 |
| 5,335,792 | | 8/1994 | Hauch | 209/687 |
| 5,507,396 | | 4/1996 | Hauch | 209/399 |
| 5,605,233 | | 2/1997 | Hauch | 209/385 |

* cited by examiner

*Primary Examiner*—John M. Jillions
(74) *Attorney, Agent, or Firm*—Patterson, Thuente, Skaar & Christensen, P.A.

(57) ABSTRACT

In a preferred embodiment of the invention, a grain grader has an improved cleaning system utilizing cascades of rollers swingably engaged with a grading cylinder. In a preferred embodiment, a multiple axle roller assembly for dislodging clogged grain in the apertures is suspended from above the cylinder with multiple the rollers swingable in a downward arc to engage the cylinder. Such roller assembly may include a lifting mechanism to raise and lower the assembly for selective engagement with the rotating trammel and to facilitate removal and insertion of cylinders. The roller assembly has a plurality of stages to effectively provide unclogging action without gaps across the entire width of the trammel.

11 Claims, 3 Drawing Sheets

GRAIN GRADER

The present invention relates to grain graders. More particularly, the invention relates to grain graders with assemblies for unclogging apertures in the rotating cylinder.

BACKGROUND OF THE INVENTION

Grain graders utilize cylinders with apertures suitably sized for a particular size of grain to be sorted. The grain to be sorted is fed into a first end of the cylinder. The rotational axis of the cylinder is angled with respect to the horizontal such that as the grain is tumbled inside the cylinder it flows to the opposite second end of the cylinder. The grain of a size or configuration that fits through the apertures is sorted out of the cylinder. The balance of the grain flows out of the second end.

Grain graders typically have interchangeable cylinders for providing different sorting parameters. Such parameters often relate to an aspect of the grain such as size or maximum diameter. Modern graders require guard screens or other barriers to keep personnel away from the rotating parts. In many installations, the cylinders need to be regularly or frequently swapped for altering the sorting parameters. It is desirable to be able to access the cylinders and to interchange them as easily and as quickly as possible.

The apertures in the grain grader cylinders have a tendency to become clogged by grain not quite small enough to freely pass through the apertures. Means are typically provided for unclogging the apertures. In the early art, such means included elongate rigid wooden rollers extending across the top exterior of the cylinder. Such cylinders have been disclosed as rigidly fixed, see U.S. Pat. No. 410,377 issued to Rich, and vertically movable by the roller axle ends placed in vertical slits in mounting blocks, see U.S. Pat. No. 174,078 issued to Kurth. Additionally, rollers have been disclosed in the context of a pea grader that comprise wooden rollers covered with crepe rubber on an axle with the axle supported by a pair of links pivoting on the grader frame and extending upwardly to allow the rollers to pivot against the cylinder. See U.S. Pat. No. 1,841,299 to Rife. An inherent problem with such rollers as disclosed in the prior art is that they do not adequately address differences between different cylinders that may be used in the same grader, nor do they address the issue of inconsistencies in the roundness or existence of imperfections in a cylinder, nor did they address the modern practice of frequent cylinder exchanges. In conventional roller systems, an imperfection or distortion at one point on the exterior of a cylinder can cause a substantial portion of a roller assembly to separate from the cylinder causing significant breaches in the cleaning coverage. This is particularly a problem where there is such a frequent cylinder interchange. Moreover, the prior art rollers did not provide for nor were they capable of simple and safe separation from engagement with the cylinders. To applicants knowledge, such rigid rollers have not been utilized for cleaning grain graders for many decades.

Other means for unclogging the apertures have included elongate cylindrical brushes with the bristles extending into the apertures as the cylinder and brushes rotate to push any lodged material back into the interior of the cylinder. Such a brush is disclosed in U.S. Pat. No. 4,469,230 to Gorlitz, et al.

The current commercially accepted method of cleaning the cylinders of grain graders is by utilizing a rotating cleaner unit with elongate flexible flaps extending outwardly from a hub which extends down the length of the cylinder.

The cleaner unit is rotatably driven such that the flaps slap against the cylinder to urge any lodged grain back into the cylinder. Such a system is disclosed in U.S. Pat. No. 5,605,233 to Hauch. There are significant disadvantages with this type of system some of which are disclosed in Hauch. Although Hauch attempts to provide a solution to a specific problem, the Hauch design still requires the flapper member to be powered and there will still be torque spikes due to the slapping action of the flaps. Moreover, the efficiency of these types of cleaners is not as great as desirable. Additionally, in operation such flap cleaners can contribute substantially to the noise generation of graders. These types of cleaner are also require relatively frequent maintenance.

A cleaner for a grader is needed that is more efficient in operation, that accommodates distortions and imperfections in cylinders, that accommodates frequent cylinder interchanges including cylinders of different sizes without equipment adjustment or modification, and that is low maintenance.

SUMMARY OF THE INVENTION

In a preferred embodiment of the invention, a grain grader has an improved cleaning system utilizing cascades of rollers swingably engaged with a grading cylinder. In a preferred embodiment, a multiple axle roller assembly for dislodging clogged grain in the apertures is suspended from above the cylinder with multiple the rollers swingable in a downward arc to engage the cylinder. Such roller assembly may include a lifting mechanism to raise and lower the assembly for selective engagement with the rotating trommel and to facilitate removal and insertion of cylinders. The roller assembly has a plurality of stages to effectively provide unclogging action without gaps across the entire width of the trommel.

An object and advantage of specific embodiments of the invention is that the roller assembly is highly amenable to retrofitting on existing grain graders. Moreover the roller assembly can operate in conjunction with other types of cleaning elements such as the rotary flapper units or can be selectively operated as appropriate for a particular grading operation.

An object and advantage of specific embodiments of the invention is that the apparatus requires minimum maintenance. The rollers are not driven except by contact with the cylinder and there are no bearings or other components requiring periodic maintenance.

A further object and advantage of specific embodiments of the invention is that the multiple stage design allows the mechanism to lift the suspension linkage at the central location of the roller assembly thereby allowing use of a mechanically simple and reliable lifting mechanism.

A further object and advantage of specific embodiments of the invention is that the preferred lifting mechanism is mechanically simple and easy to use, can be operated with the guard screens in place, and is essentially maintenance free.

A further object and advantage of specific embodiments of the invention is that no drive system is needed and thus no separate guards covering such a drive system is needed.

A further object and advantage of specific embodiments of the invention is that the rollers and suspension linkage can accommodate different sizes of cylinders without adjustment or modification.

A further object and advantage of specific embodiments of the invention is that the use of high density polyethylene or other plastic materials provide a long lasting engagement element as well as minimizing noise production from the cleaning operation.

A further object and advantage of particular embodiments of the invention is that localized irregularities in the cylinder have minimum impact on the effectiveness of the rollers on the other areas of the cylinder.

A further object and advantage of particular embodiments of the invention is that the rollers are not separately driven, rather they are rotated by way of their engagement with the trommel.

A further object and advantage of particular embodiments of the invention is that the roller assembly may be easily disengaged and lifted out of the way for removal and replacement of the rotating cylinder.

DETAILED SPECIFICATION

Figure 1:
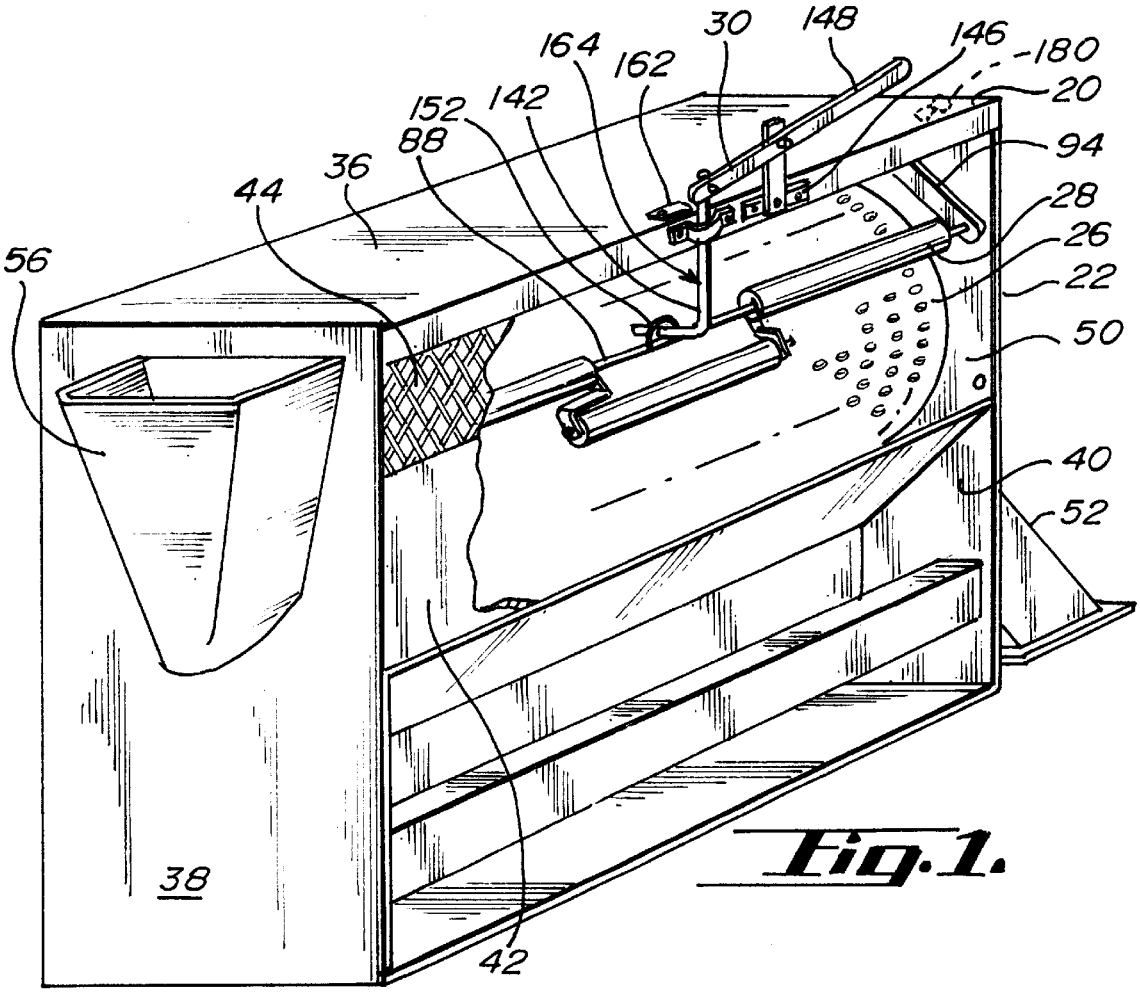
FIG. 1 is a perspective view of a grain grader according to the invention with a portion of a side panel cut-away.
Figure 2:
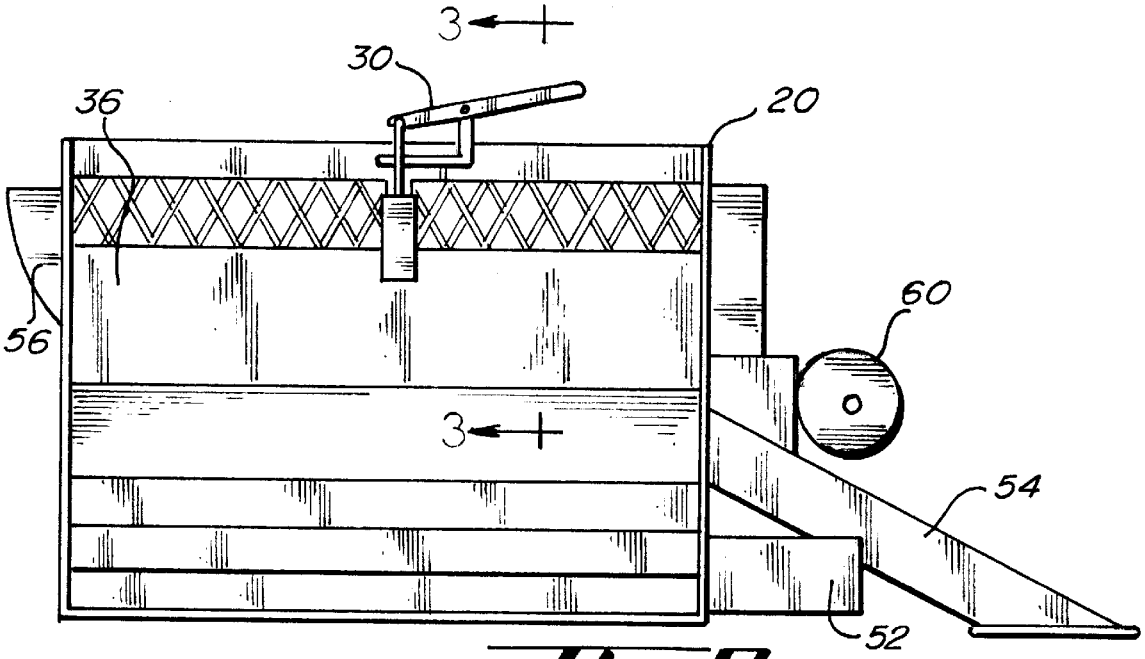
FIG. 2 is a side elevational view of a grain grader according the invention.
Figure 3:
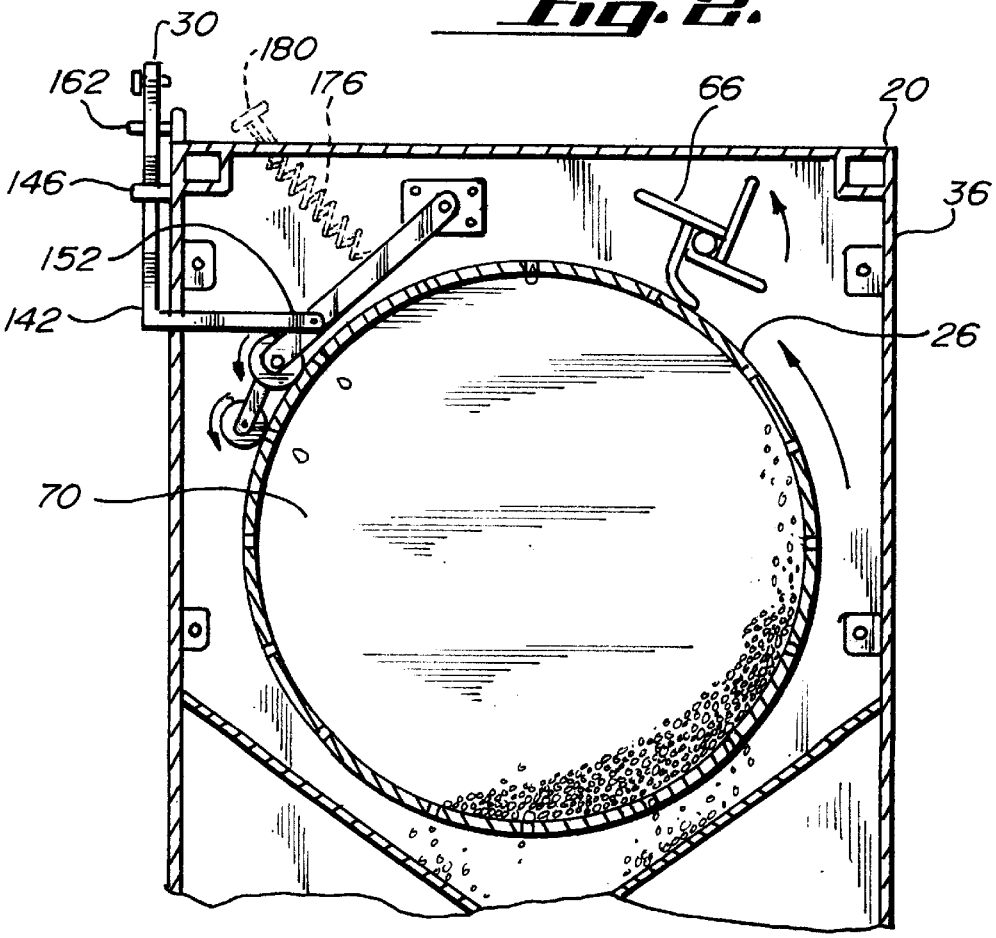
FIG. 3 is a cross-sectional view of the grain grader of FIGS. 1 and 2 taken at approximately line 3—3 of FIG. 2.

Referring to FIG. 1 a grain grader in accordance with the invention is generally designated with the numeral 20 and is principally comprised of a support structure 22, a hollow apertured cylinder 26, a cleaning portion 28, and a lifting mechanism 30. Except for the lifting mechanism and cleaning portion 28, the grain grader as shown in FIGS. 1, 2, and 3 are generally conventional including the drive systems for rotating the cylinders. As such, the operation of such graders will not be described in detail. Reference is made to U.S. Pat. No. 4,469,230 assigned to AG Gebrueder Buehler for general disclosure regarding operation and construction of grain graders. Said patent is incorporated by reference herein.

Referring to FIGS. 1, 2, and 3, the support structure for grain graders may be generally configured as shown in these figures. The grain grader generally has a housing 36 which may comprise permanently mounted sheet metal which may form part of the support structure, such as the end panels 38, 40 or may comprise removable panels such as the side panels 42 which can include grating 44. The removable panel closes the open side 50 of the grain grader which accommodates the insertion and removal of the cylinder 26 for exchange or repair or other maintenance.

The grain grader has a plurality of hoppers or grain chutes 52, 54, 56 which are utilized for receiving the grain to be sorted and for discharging the sorted grain. A drive system 60 includes an electric motor and suitable drive components for rotation of the cylinder 26 and other powered components such as grain conveyors or ancillary cleaning apparatus such as a rotating flapper cleaning portion 66 as portrayed in FIG. 3. The drive means may utilize electric motors, hydraulic motors or a power take off. Such rotating flapper cleaning portions are commonly utilized in existing grain grader equipment. It is to be understood that the novel cleaning portion and lifting mechanism is disclosed herein and illustrated best in FIGS. 1, 3, 5, and 6, may be utilized to replace, supplement or use selectively with other cleaning portions such as the rotating flapper cleaning portion 66 as illustrated in FIG. 3.

Figure 4:
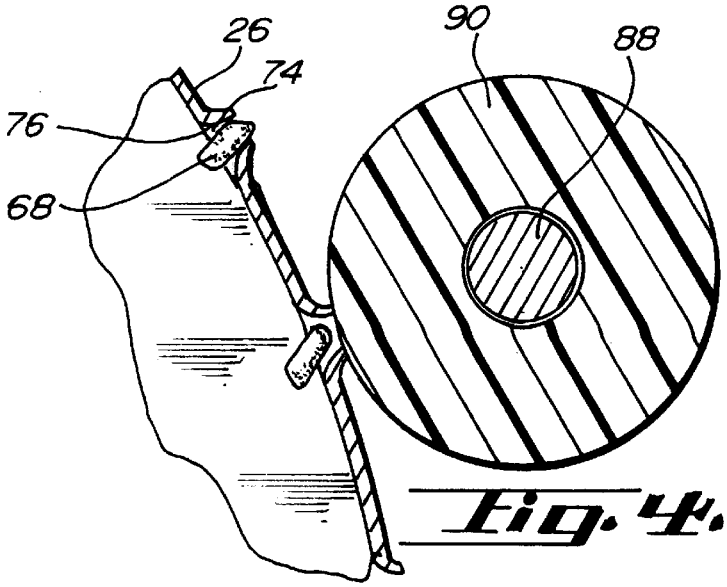
FIG. 4 is a detailed drawing of one of the rigid plastic rollers engaging the hollow cylinder to dislodge grain in the apertures.

Referring to FIGS. 3 and 4, the rotating apertured cylinder has a tendency to have the sorted material become lodged as shown by the grain kernel 68 shown in FIG. 4. Upon contact with the cleaning portion the kernel is pushed backwards through the aperture to fall back into the interior 70 of the rotating cylinder. Conventional cylinders typically have apertures 74 with a slight funnel or frusto conical shaped interior surface 76 as shown in FIG. 4. With such shaped apertures any kernel lodged therein will, in most all cases, have a portion protruding to the exterior of the cylinder which may then be contacted by the cleaning portion.

Figure 5:
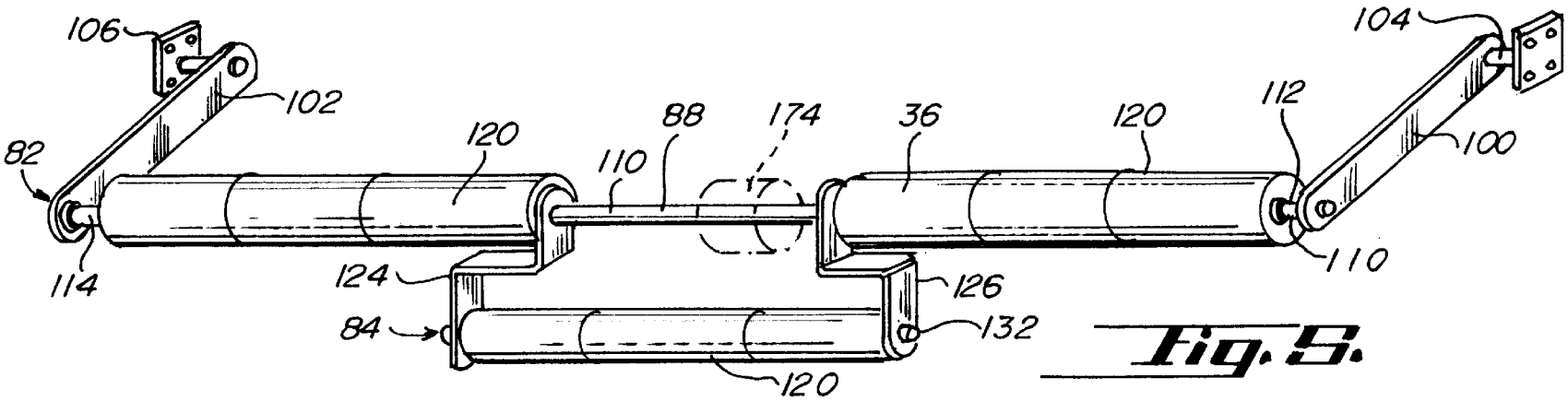
FIG. 5 is a detailed perspective view of a cleaning portion according to one embodiment of the invention.

Referring to FIGS. 1, 3, 4, 5, and 6, preferred embodiments of the cleaning portion according to the invention are illustrated. The cleaning portions comprise a plurality of roller stages 82, 84 which cooperate to provide complete and virtually uninterrupted coverage of the apertures of the rotating cylinder. Each stage comprises at least one axle 88 and one roller 90. A suspension linkage 94 is utilized to support the rollers and allow them to swing into engagement with the exterior of the cylinder. In FIG. 5 the suspension linkage comprises a pair of first links 100, 102 which are pivotally connected to a pair of mounting brackets 104, 106 which are attachable to the support structure 22. The first linkages 100, 102 extend downwardly to the first stage 82 which, as shown, is comprised of a first axle 110 with two ends 112, 114 and a plurality of plastic rollers 120 placed thereon. As illustrated in FIG. 4 the plastic rollers 90 are generally loosely fit on the axle 88. The use of a high density polyethylene has excellent inherent slipperiness and separate bearings are not warranted.

Although a preferred embodiment utilizes high density polyethylene it should be recognized that other types of plastic and other types of materials which may be particularly suited for a specific application may be utilized in place of the high density polyethylene. For example, softer materials, such as elastomeric materials can provide comparable unclogging action while reducing noise generation.

Figure 6:
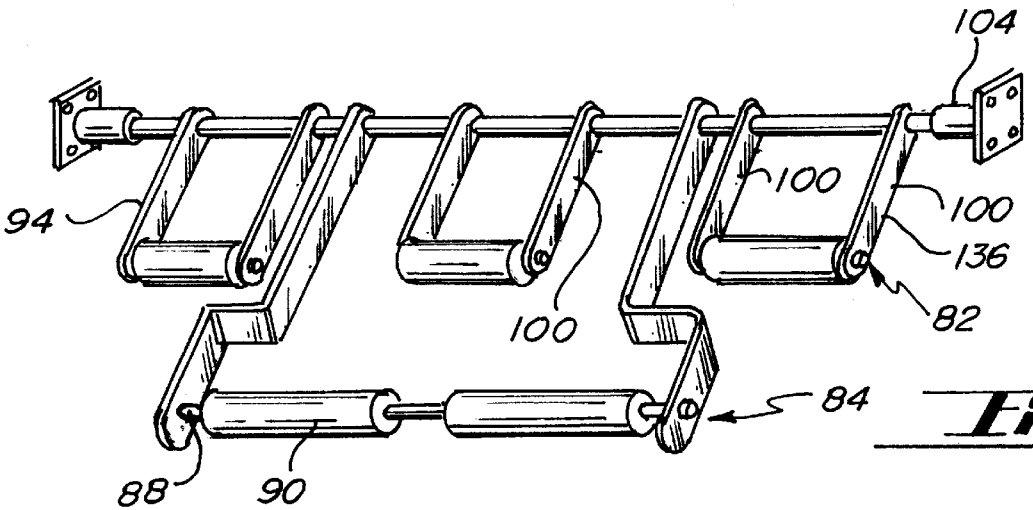
FIG. 6 is a perspective view of an additional embodiment of the invention.

Referring again to FIG. 5 a pair of offset links 124, 126 are pivotally connected to the first stage on the first axle 110 and extend downward and outwardly to pivotally support a second axle 132. A plurality of additional rollers 120 are disposed on the second axle 132. With this configuration each of the stages function substantially independently of the other stage and each of the individual rollers are isolated to a significant extent from the other rollers. Referring to FIG. 6, further segmentation of the first stage 82 is provided with three separate isolated rollers on three separate sets 136 of first links. Such segmentation can be provided to increase isolation with respect to the lengthwise aspect of the cylinder.

Although two stages are shown in the figures it is anticipated that additional stages may be added where desired or appropriate for particular application or design of equipment. It is also noted that the cascading of the stages may be provided by means other than the specific suspension linkage as shown.

Referring to FIGS. 1, 2, and 3, the lifting mechanism 30 is depicted. In the embodiment shown, a lifting arm 142 is connected to the cleaning portion at the first stage on the first axle. The lifting arm is vertically movable within a mounting bracket 146 attached to the support structure. A lever arm 148 may be utilized to raise the lifting arm and thus lift the cleaning portion 28 upwardly. Sufficient play may be provided at the connection 152 between the lifting arm and the first stage or at the lifting arm and the bracket 146 to accommodate the movement of the first stage in an upward and downward arc as opposed to a pure vertical motion. Other lifting mechanisms may be provided such as extensions or connections to the set of first links. However, the lifting mechanism as shown and particularly its attachment to the intermediate section of the first roller assembly facilitates a simple and easy retrofit to existing grain graders. Similarly, the use of the brackets 104, 106 to attach to the interior surfaces of the end panels facilitate an easy retrofit.

A latching member 162 may be utilized to engage a recess 164 in the lifting arm when the lifting arm and the cleaning portion 28 are in the raised position. Such locking means may also be accommodated by a spring loaded detente or a similar mechanism.

The downward bias of each stage may be provided simply by the weight of the suspension linkage and roller assemblies. Alternatively, supplemental weights 174 as illustrated in FIG. 5 may be utilized. Alternatively, either downward or upward bias may be provided by a spring 176 and adjustment mechanism 180 connecting to the first links as shown in FIGS. 1 and 3.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A grain grader comprising:

a) a support structure with an open interior and open side;

b) a closure panel to removably close the open side;

c) a hollow cylinder rotatably positioned in the support structure, the hollow cylinder accessible and removable from the open side, the cylinder having a plurality of apertures suitably sized for sorting grain;

d) a drive system connected to the cylinder whereby the cylinder may be rotated;

e) a first roller stage comprising:

at least one axle extending lengthwise along the exterior of the cylinder;

a plurality of plastic rollers attached to the at least one axle;

f) a suspension linkage mounted to the support structure and supporting the axle, the suspension linkage providing a pair of pivot points above the cylinder whereby the axle with the plurality of plastic rollers attached thereto is pivotally swingable in a downward arc to engage the exterior of the cylinder; and g) a second roller stage connected to the suspension linkage below the first axle, the secondary axle suspended to swing in a downward arc to engage the exterior of the cylinder.

2. The grain grader of claim 1, wherein the first roller stage comprises a pair of end sections and an intermediate section, and wherein the grain grader further comprises a lifting linkage including a lifting arm, the lifting arm connected to the intermediate section of the first roller stage and movable vertically to selectively move the first and second roller stages into and out of engagement with the cylinder.

3. The grain grader of claim 1, wherein the first roller stage and second roller stage are position on the side of the cylinder adjacent the open side, and wherein the grain grader further comprises a lifting mechanism for raising the first and second roller stages out of the way of the cylinder facilitating removal of the cylinder from the support structure.

4. A grain grader comprising:

a) a support structure with an open interior and open side;

b) a hollow cylinder removably securable in the open interior of the support structure and accessible and removable from the open side, the cylinder having a plurality of apertures suitably sized for sorting grain;

c) a drive system connected to the cylinder whereby the cylinder may be rotated;

d) a cleaning portion comprising:

a suspension linkage pivotally connecting to the support structure above the cylinder and extending downwardly;

a plurality of rollers suspended by the suspension linkage, the rollers swingable in a downward arc to engage the exterior of the cylinder; and e) a vertically moveable lifting arm attached to the cleaning portion whereby the cleaning structure may be raised off of the cylinder.

5. The grain grader of claim 4 wherein the cleaning portion comprises:

a) a first roller assembly comprising:

b) a first axle with two ends extending lengthwise along the exterior of the cylinder;

c) at least one roller attached to the axle;

d) a second roller assembly comprising:

a second axle with two ends extending lengthwise along the exterior of the cylinder; and e) at least one roller attached to the second axle.

6. The grain grader of claim 5 where in the first roller assembly and the second roller assembly are circumferentially spaced on the cylinder when engaged therewith.

7. The grain grader of claim 4, further comprising a second cleaning portion mounted to the support structure above the cylinder, the second cleaning portion comprising a rotatable hub, a plurality of elongate flaps extending from the hub, a drive system connected to the hub to rotate the hub with the plurality of flaps, the hub mounted to the support structure adjacent to and above the cylinder whereby said flaps strike the exterior of the cylinder when the hub rotates.

8. A grain grader comprising:

a) a support structure with an open interior and an inlet spout;

b) a hollow cylinder removably positioned in the support structure, the inlet spout extending to the interior of the hollow cylinder, the cylinder from the support structure, the cylinder having a plurality of apertures suitably sized for sorting grain;

c) a drive system attached to the support structure and connected to the cylinder whereby the cylinder may be rotated;

d) a roller portion comprising an axle and a plurality of plastic rollers rotatably mounted thereon;

f) a suspension linkage mounted to the support structure and supporting the axle, the suspension linkage providing a pair of pivot points above the cylinder whereby the roller portion is pivotally swingable in a downward arc to engage the exterior of the cylinder; and g) a lifting mechanism comprising a lifting arm connecting to one of the roller portion and the suspension linkage, the lifting arm movable upwardly to disengage the roller portion from the cylinder, the lifting mechanism including a latching portion to secure the lifting arm in an upward position.

9. A retrofitable cleaning system for a grain grader, the grain grader comprising a rotatable apertured cylinder mounted in a support structure with an openable side, the cylinder removable from the support structure through the open side, the cleaning system comprising:

a) a roller portion comprising an axle and a plurality of rigid rollers rotatably mounted thereon;

b) a suspension linkage mountable to the support structure for supporting the axle, the suspension linkage providing a pivot point above the cylinder whereby the roller portion is pivotally swingable in a downward arc to engage the exterior of the cylinder; and c) a lifting mechanism comprising a lifting arm connectable to one of the roller portion and the suspension linkage, the lifting arm movable upwardly to disengage the roller portion from the cylinder, the lifting mechanism including a latching portion to secure the lifting arm in an upward position.

10. A method of unclogging grain from the rotating cylinder of a grain grader, the rotating cylinder supported in a support structure and having a multiplicity of apertures, the method comprising the steps of:

a) suspending a suspension linkage from the support structure, b) engaging a first stage of at least one roller attached to the suspension linkage whereby said roller swings against and engages the rotatable cylinder, c) engaging a second stage of at least one roller attached to the suspension linkage circumferentially spaced from the first stage whereby said second stage of at least one roller also swings against and engages the rotatable cylinder, and d) rotating the cylinder.

11. The method of claim 10 further comprising the step of suspending the second stage from the first stage.

* * * * *